United States Patent [19]

Casella

[11] Patent Number: 4,974,277

[45] Date of Patent: Dec. 4, 1990

[54] PNEUMATIC GUN

[75] Inventor: David W. Casella, Wanneroo, Australia

[73] Assignee: Technic Pty., Ltd., Australia

[21] Appl. No.: 406,904

[22] Filed: Sep. 14, 1989

[51] Int. Cl.[5] ..... B08B 9/04

[52] U.S. Cl. ..... 15/3.5; 406/38

[58] Field of Search ..... 15/3.5, 3.51, 104.063; 239/114; 406/38

[56] References Cited

U.S. PATENT DOCUMENTS

| | | | |
|---|---|---|---|
| 1,806,270 | 5/1931 | Thompson | 15/3.5 |
| 1,867,751 | 7/1932 | Oberhuber | 15/3.5 |
| 3,631,555 | 1/1972 | Hurst et al. | 15/3.5 |
| 4,252,255 | 2/1981 | Henderson | 15/3.5 |
| 4,467,488 | 8/1984 | Creek | 15/3.5 |

*Primary Examiner*—Edward L. Roberts

*Attorney, Agent, or Firm*—Larson and Taylor

[57] ABSTRACT

A hand held pneumatic gun having an airway that is coupled to a source of compressed air, the airway communicating with an air chamber via a trigger valve. The gun includes a detachable breech that is supported in sealed engagement against the air chamber by a support ring pivotally secured to the body of the gun. The breech incorporates a nozzle that is secured to one end of a piece of hose or tube and a polymer projectile is placed into the breech to be forced by the air pressure through the hose or tube to clean the interior of the hose or tube.

12 Claims, 3 Drawing Sheets

PNEUMATIC GUN

BACKGROUND OF THE INVENTION

This invention relates to a pneumatic gun and particularly to a gun for use in the internal cleaning of hose or tube.

There has always been a problem in keeping hose, tube or pipe work internally clean. Where the hose or tube is used for instance in the food industry or in a medical environment, it becomes critical that the lines remain clean. Similarly, in hydraulic and pneumatic lines internal contamination can cause breakdown and costly downtime. One problem that is frequently encountered with hose or tube concerns the manufacturer's grease, powders or other byproducts that are present in the lines after manufacture. There is thus a necessity to clean all lines before use.

PRIOR ART

One very efficient means of cleaning hose and tube is to force a compressible projectile that has an outside diameter greater than the internal diameter of the hose through the line under pressure. The projectile as it travels along the hose or tube thus removes particulate material from the internal wall. A number of projectiles can be repeatedly passed through lengths of the hose or tube under pressure to ensure that all contaminate matter has been removed. The usual means of effecting this cleaning operation is to place the projectile in a compressed air gun and then operate a valve to cause compressed air to flow through the gun and into the tube via a nozzle that is coupled to the end of the hose or tube. The compressed air forces the projectile through the nozzle into and along the tube to clean the interior of the pipe. A problem with this type of equipment is that for the system to work satisfactorily by ensuring that the projectile does not get stuck in the hose or tube it is most important that there is no air loss between the gun and the tube. Since hose and tube comes in a variety of diameters and materials there is a need for a pneumatic gun that can be adapted simply for use over a range of hose products. It is this need that has brought about the present invention.

SUMMARY OF THE INVENTION

According to the present invention there is provided a hand held pneumatic gun having an airway arranged to be coupled to a source of compressed air, the airway communicating with an air chamber via a trigger valve, a detachable breech coaxially supported by a support ring pivotally secured to the body of the gun to move from an open position where the breech can be detached to a closed position where the breech is sealed against the air chamber to allow, on actuation of the trigger valve passage of compressed air into the breech.

Preferably, a releasable latch is arranged to engage the support ring to hold the ring in the closed position. In a preferred embodiment the air chamber is provided with an inclined internal surface that is parallel to a corresponding inclined external surface formed on the adjacent end of the breech. Furthermore, in the preferred embodiment an O-ring is located in the internal surface of the air chamber to in use form an air seal against the adjacent external surface of the breech.

Preferably, the breech has an external cylindrical mounting portion that is a close fit against the inner surface of the support ring. In a preferred embodiment an O-ring is provided on the internal surface of the support ring to engage the mounting portion on the exterior of the breech.

In the preferred embodiment the gun comprises a handle that is detachably secured to a body portion, the front of which defines the air chamber, the trigger is positioned in the airway that inter-connects the handle to the air chamber.

DESCRIPTION OF THE DRAWINGS

One embodiment of the present invention will now be described by way of example only with reference to the accompanying drawings in which.

DESCRIPTION OF THE PREFERRED EMBODIMENT

Figure 7:
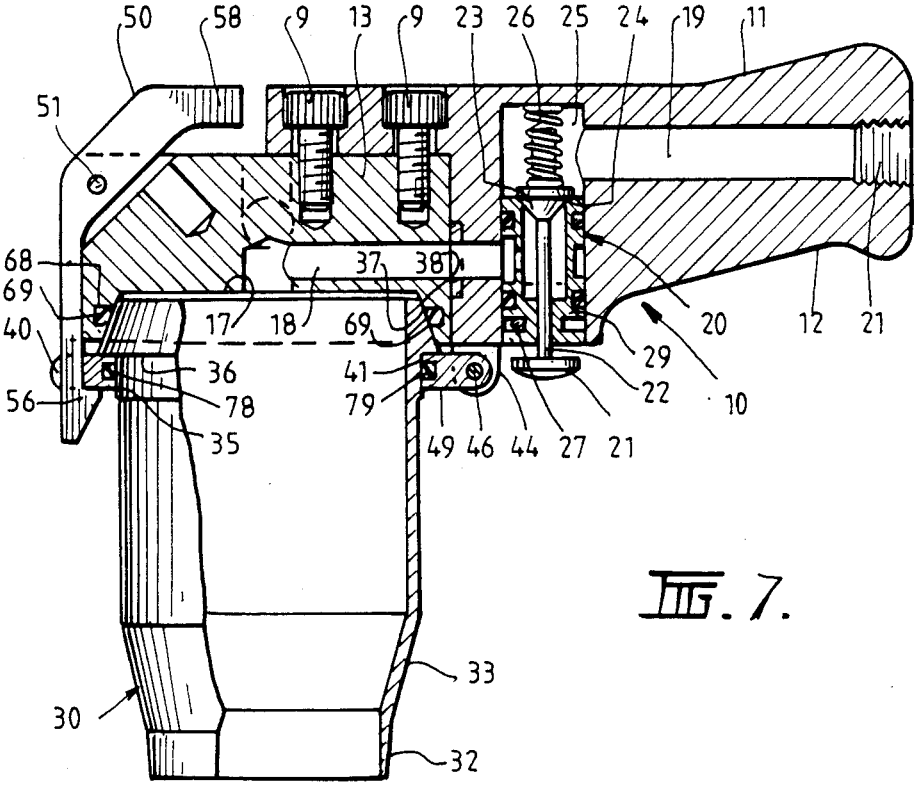
FIG. 7 is a cross sectional view of the gun with a breech/nozzle assembly attached.

As shown in the accompanying drawings with particular reference to FIG. 7 a pneumatic gun 10 comprises a handle 11 including a finger grip portion 12 that is bolted to main body portion 13 by set screws 9. The main body portion is of circular cross section and has a front face 14 which defines an air chamber 15. As shown in FIG. 7 the air chamber 15 has a centrally positioned aperture 17 that communicates with an airway 18 which in turn communicates with an airway 19 in the handle 12 via a spring loaded trigger valve 20. The base of the handle has, an internally threaded aperture 21 into which a source of compressed air may be coupled so that the air, on release of the trigger valve can pass through the handle and airways 19 and 18 to the air chamber 15.

The trigger assembly 20 comprises a trigger 21 coaxially mounted on a spindle 22, one end of which terminates in a conical valve member 23 which is arranged to seat against a correspondingly tapering surface 24 formed on a nylon sleeve 29 that locates in an internal bore 25 of the handle 11. A transverse pin 27 extends across the sleeve 29 and through the handle to hold the sleeve in position. A spring 26 urges the spindle 22 and trigger 21 to the closed position thereby preventing air from passing to the main body portion. When the spring 26 is compressed by pressing the trigger 21 the valve opens allowing compressed air to flow through the airways 19 and 18 to the air chamber 15.

At the front face 14 of the main body portion 13 there is provided an annular support ring 40 that has planar rear and front faces 48 and 49. The support ring 40 has a projecting lug 47 on one side that is supported about a pin 46 between a pair of webs 44 and 45 that project from the handle adjacent the front surface 14 of the gun. The support ring is thus secured to the gun for pivotal displacement from a closed position as shown in all figures but FIG. 6 to an open position (not shown) in which the plane of the ring extends horizontally, as viewed in figure 7.

Figure 1:
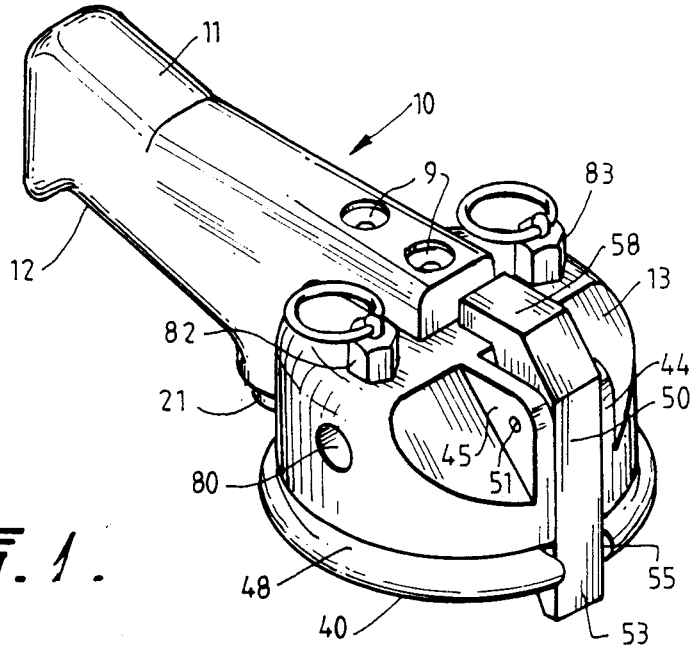
FIG. 1 is a perspective view of the rear of the pneumatic gun.
Figure 2:
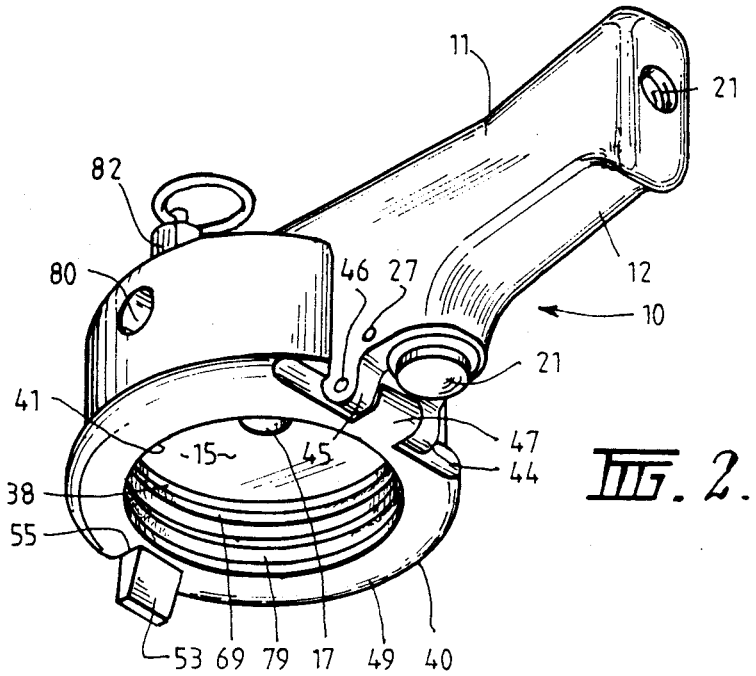
FIG. 2 is a perspective view of the gun from the front.
Figure 3:
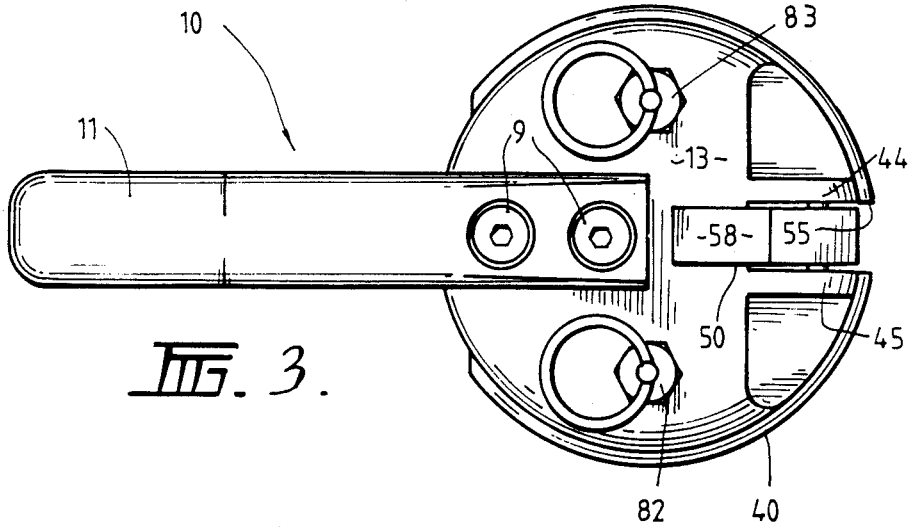
FIG. 3 is an elevational view of the gun from the rear.
Figure 4:
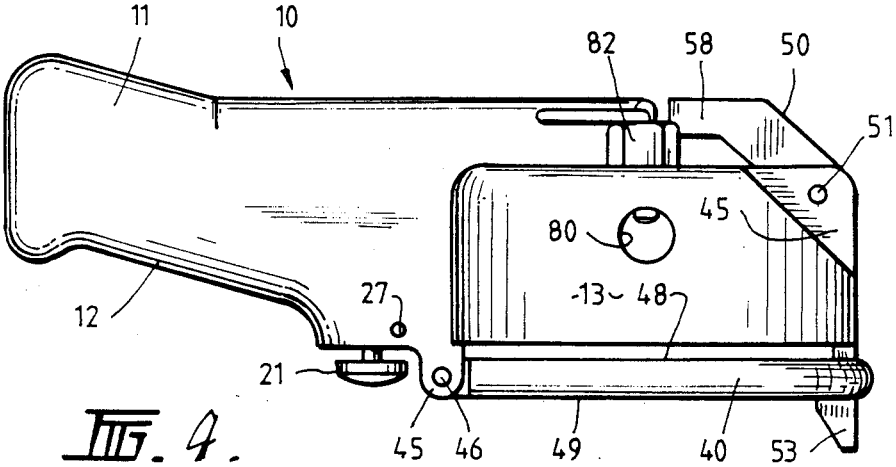
FIG. 4 is a side elevational view of the gun.
Figure 5:
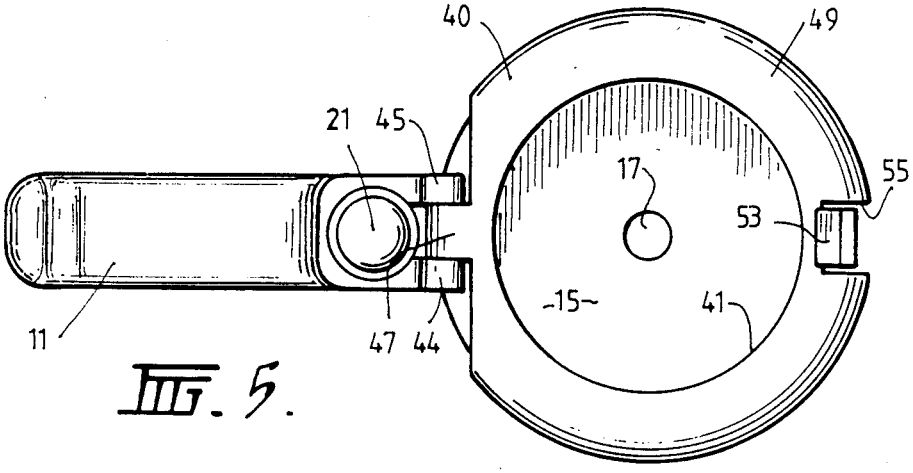
FIG. 5 is an elevational view of the gun from the front.
Figure 6:
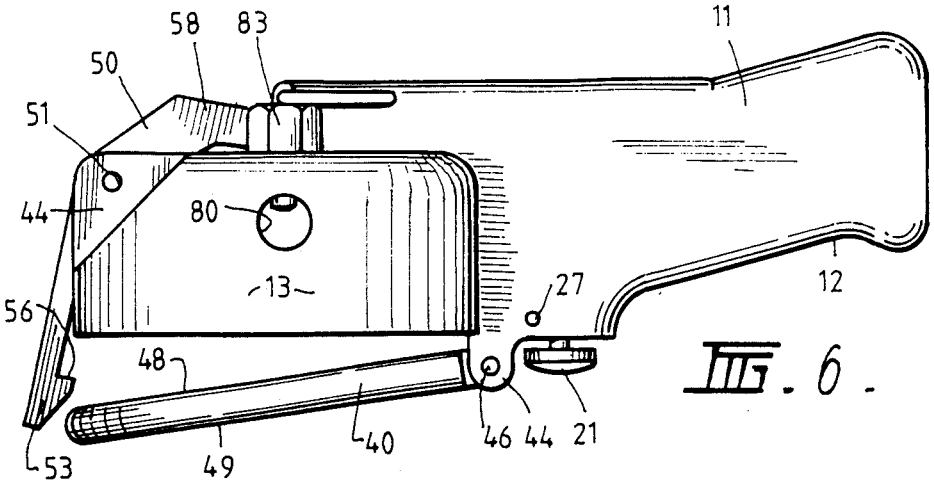
FIG. 6 is a side elevational view of the gun with a support ring in an unlatched position.

A L-shaped latch member 50 is pivotally secured to the upper rear face of the body portion 13 via a pin 51. The latch member 50 has a forwardly extending portion 52 that terminates in a tapered latch tongue 53 that locates in a cut-out 55 formed in the periphery of the support ring 40. The latch tongue 53 has a shoulder 56 that fits against the front face 49 of the ring to hold the ring in a closed position as shown in FIG. 7. The latch member 50 is urged by a spring (not shown) to the latched position shown in FIGS. 1 to 5 and FIG. 7. By pressing the rear 58 of the latch member 50 as shown in FIG. 6, the tongue 53 pivots clear of the cut-out in the ring 40 thereby allowing the ring to pivot open.

A combined breech and nozzle assembly 30 has an internal cylindrical bore 31 which tapers divergingly towards the outer end 32 to define a nozzle portion 33. The internal cylindrical bore 31 defines a breech for a projectile (not shown). The combined breech and nozzle assembly 30 is detachably supported on the pneumatic gun by the support ring 40, the internal surface 41 of which is arranged to be a close sliding fit on a locating surface 35 formed on the exterior of the cylindrical portion of the breech. The support ring 40 locates against an annular shoulder 36 formed on an external frustoconical portion 37 which is parallel to a similarly shaped frustoconical annular surface 38 formed on the wall of the air chamber 15. The internal frustoconical surface of the air chamber 15 is provided with an annular groove 68 into which a suitable O-ring 69 is positioned. The O-ring 69 is arranged to be in sealed engagement with the frustoconical surface 37 of the shouldered end 36 of the breech/nozzle 30. The internal surface 41 of the support ring 40 is also provided with an annular groove 78 into which an O-ring 79 is located. The O-ring 79 forms a seal on the external periphery of the nozzle/breech assembly 30. The two O-rings 69 and 79 remain in position on the support ring 40 and the air chamber 15 of the pneumatic gun so that as the breech-/nozzles are interchanged there is no need to change or replace the O-ring. However easy access is provided to the O-rings to allow replacement as they become worn.

When the support ring 40 is unlatched to the open position, the breech/nozzle assembly 30 can be pushed off the ring by sliding the narrower end 32' through the ring 40. In this manner a number of different breech-/nozzle assemblies may be supported by the ring, each having different internal dimensions to correspond with different diameters of hose or tube on which the pneumatic gun is to be used.

To operate the gun, a source of compressed air at between 100–140 lbf/sq.in is coupled to the inlet 21 of the handle 11 of the gun. Especially designed projectile in the form of a polymer pellet that is 20% larger than the internal diameter of the tube or hose that is to cleaned is positioned to be a close fit within the breech 31. The projectile is loaded into the breech 31 by releasing the support ring 40 by use of the latch 50, positioning a projectile into the rear of the breech/nozzle 30 and then closing the ring 40 against the latch 50. The free end 32 of the breech/nozzle 30 is then coupled to the line in question and the trigger valve 20 released causing compressed air to flow into the air chamber 15 against the end surface of the projectile in the breech 31. The air pressure forces the projectile to escape through the nozzle 33 into the line to be forced along the length of line to strip out all internal contamination. The location of the breech/nozzle 30 in the support ring 40 allows the gun to be used with a large variety of sizes of pellets. In the preferred embodiment, the gun can be used with pellets ranging from 4mm to 60mm in diameter. The pellets are made from polyurethane foam impregnated wire, a suitable adhesive to form cylindrical pellets of the diameters described above. The length of each pellet varies from between 20–100 mm depending on the diameter. The combined nozzle breech/nozzle assembly 30 is also arranged to be used with other adapters that allow the gun to be coupled to a large variety of hose couplings.

Although the gun is designed to be hand held, bores 80 and 81 are positioned on each side of the rear of the main body portion 13 to allow the gun to be bolted to a work bench. A pair of spring loaded pins 82 and 83 can be used to ease location of the gun on the bench without the use of bolts.

The pneumatic gun described above is specifically designed to be sold as a kit with a variety of nozzles and adapters for use with flexible and rigid hose, pipe and tube of many types and internal diameters. A large variety of polymer pellets are supplied with the kit. The latched annular ring and its association with the air chamber with O-rings positioned both in the ring and the air chamber allow simple interchangeability of the breech/nozzle assemblies without causing critical loss of pressure. The gun is virtually maintenance free and sufficiently versatile for both bench mounted or hand held use.

Having now described my invention what I claim is:

1. A hand held pneumatic gun having an airway arranged to be coupled to a source of compressed air, the airway communicating with an air chamber via a trigger valve, a detachable breech coaxially supported by a support ring pivotally secured to the body of the gun to move from an open position where the breech can be detached to a closed position where the breech is sealed against the air chamber to allow, on actuation of the trigger valve passage of compressed air into the breech.

2. A pneumatic gun according to claim 1 wherein the detachable breech has an internal bore that, tapers at one end to correspond with the internal bore of a hose or tube to which the gun is to be attached, the internal bore including a breech portion adapted to accommodate a projectile.

3. A pneumatic gun according to claim 1 wherein a releasable latch is arranged to engage the support ring to hold the ring a in closed position.

4. A pneumatic gun according to claim 3 wherein the air chamber is provided with an inclined internal surface that is parallel to a corresponding inclined external surface formed on the adjacent end of the breech.

5. The pneumatic gun according to claim 4 wherein an O-ring is located in the internal surface of the air chamber to in use form an air seal against the external surface on the breech.

6. A pneumatic gun according to claim 1 wherein the breech has an external cylindrical mounting portion that is a close fit against the inner surface of the support ring.

7. The pneumatic gun according to claim 6 wherein an O-ring is provided on the internal surface of the support ring to engage the mounting portion on the exterior of the breech.

8. The pneumatic gun according to claim 1 wherein a shoulder of larger cross section than the support ring is provided at one end of the breech so that the breech is coaxially positioned through the support ring until the shoulder abuts the adjacent surface of the ring.

9. The pneumatic gun according to claim 1 wherein a handle is detachably secured to a body portion, the front of which defines the air chamber, and wherein the trigger is positioned in the airway that interconnects the handle to the air chamber.

10. A pneumatic gun according to claim 9 wherein the airway terminates at one end of the handle, that end being arranged to be coupled to a source of compressed air.

11. A pneumatic gun according to claim wherein the trigger valve is spring loaded to a neutral position to prevent air reaching the air chamber and on actuation the trigger valve allows air to flow to the air chamber.

12. A pneumatic gun according to claim 1 wherein means is provided to facilitate attachment of the gun to an associated work bench.

* * * * *

UNITED STATES PATENT AND TRADEMARK OFFICE

CERTIFICATE OF CORRECTION

PATENT NO. : 4,974,277

DATED : December 4, 1990

INVENTOR(S) : David W. CASELLA

It is certified that error appears in the above—identified patent and that said Letters Patent is hereby corrected as shown below:

On the cover page, after "[73] Assignee:" please delete:

"Technic Pty., Ltd., Australia"

and substitute therefor:

--Compri Technic Pty. Ltd., Australia--

Signed and Sealed this

Second Day of June, 1992

*Attest:*

DOUGLAS B. COMER

*Attesting Officer*

*Acting Commissioner of Patents and Trademarks*